US007114227B2

(12) United States Patent
Lin

(10) Patent No.: US 7,114,227 B2
(45) Date of Patent: Oct. 3, 2006

(54) STRUCTURE YARN CYLINDER

(76) Inventor: Ying-Ling Lin, No. 57, Fu-Long Rd., San-Chung City, Taipei (TW)

( * ) Notice: Subject to any disclaimer, the term of this patent is extended or adjusted under 35 U.S.C. 154(b) by 311 days.

(21) Appl. No.: 10/779,497

(22) Filed: Feb. 17, 2004

(65) Prior Publication Data

US 2006/0010927 A1 Jan. 19, 2006

(51) Int. Cl.
*B65H 55/00* (2006.01)

(52) U.S. Cl. ..... 28/290; 242/172

(58) Field of Classification Search ..... 242/172, 242/173, 125.1, 125; 28/290, 289
See application file for complete search history.

(56) References Cited

U.S. PATENT DOCUMENTS 3,095,161 A * 6/1963 Atwood et al. ..... 242/159
3,103,305 A * 9/1963 Heatherly ..... 225/6
3,794,260 A * 2/1974 Sowell ..... 242/125.1
4,907,758 A * 3/1990 Powel et al. ..... 242/125.1
5,211,354 A * 5/1993 Rummage ..... 242/125.1
5,495,087 A * 2/1996 Rummage ..... 219/69.15
5,558,288 A * 9/1996 Brovelli ..... 242/172
5,702,063 A * 12/1997 Bottari ..... 242/125.2
6,779,750 B1 * 8/2004 Couchey et al. ..... 242/476.6

* cited by examiner

*Primary Examiner*—Danny Worrell

(57) ABSTRACT

An improved structure yarn cylinder that is an improvement of "Yarn Cylinder with Trench" (Taiwan P/N 201810) accomplished by extending the circumferential length of the trench, disposing numerous teeth at differing angular orientations along the two lateral walls of the trench and, furthermore, arraying the teeth in a crisscross formation on the two lateral walls to thereby effectively increase yarn snagging capacity and facilitate ease of securing.

1 Claim, 2 Drawing Sheets

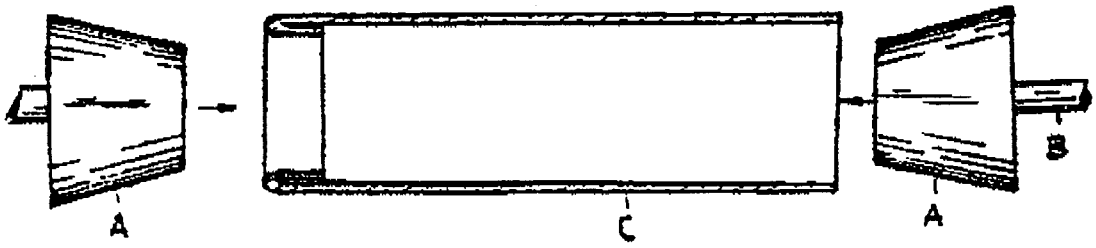
FIG. 1 (STAND DER TECHNIK)
(PRIOR ART)
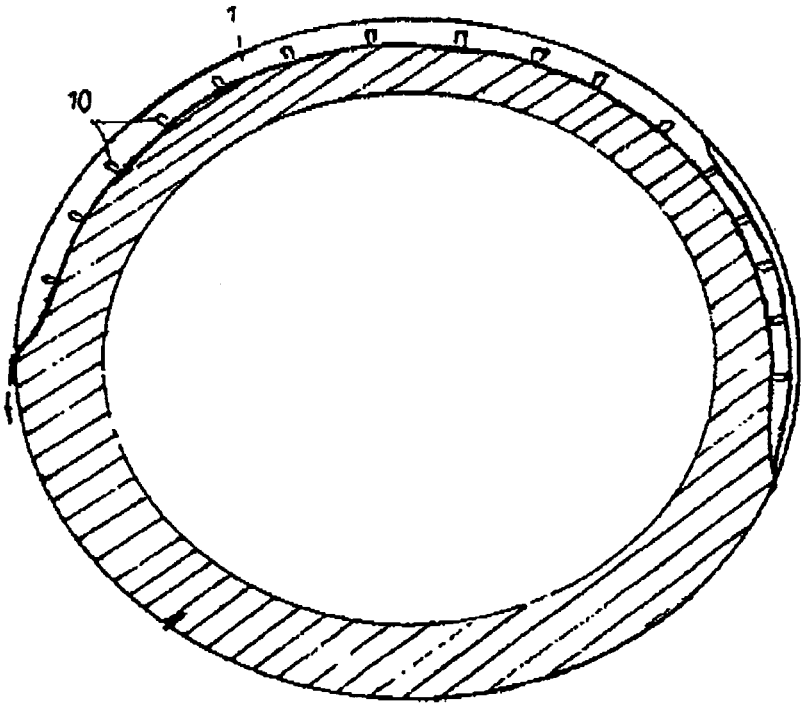
FIG. 4

STRUCTURE YARN CYLINDER

BACKGROUND OF THE INVENTION

1) Field of the Invention

The invention herein relates to yarn spools and bobbins, specifically an improved structure yarn cylinder that further enhances the utility of the yarn cylinder in "Yarn Cylinder with Trench" (Taiwan P/N 201810).

2) Description of the Prior Art

The patent "Yarn Cylinder with Trench" (Taiwan P/N 201810), as indicated in FIG. 1 and FIG. 2, a first generation yarn cylinder structure innovated by the applicant of the invention herein, is of one-piece plastic construction and since plastic is moldable, a trench 1 of an appropriate depth and width is formed around the circumferential surface of the cylinder and, furthermore, enmeshable full-distance or half-distance teeth 10 or hemihedral teeth capable of contacting another surface are disposed inside the trench 1, thereby enabling the trench 1 to snag the yarn, or the pairs of enmeshed teeth 10 or the teeth 10 contacting another surface firmly secure the yarn such that when the yarn is wound around it, this ensures the prevention of yarn loosening and slippage. As a result, the said structure has been positively evaluated and acclaimed by the industry and, furthermore, highly recommended by respected manufacturers. However, the original invention is still far from perfect and in the spirit of constant improvement, the yarn cylinder structure was enhanced to provide for further progressiveness and utility through additional refinement, which is the primary objective of the present invention.

SUMMARY OF THE INVENTION

Therefore, the primary objective of the invention herein is to provide an improved structure yarn cylinder in which the circumferential length of the trench in "Yarn Cylinder with Trench" (Taiwan P/N 201810) is extended and, furthermore, a plurality of teeth are disposed in the trench at differing angular orientations to thereby effectively increase yarn snagging capacity and facilitate ease of securing.

BRIEF DESCRIPTION OF THE DRAWINGS

FIG. 1 is a cross-sectional drawing of the "Yarn Cylinder with Trench" (Taiwan P/N 201810) as viewed from a vertical perspective.

FIG. 4 is a cross-sectional drawing of the invention herein, as viewed from a horizontal perspective.

DETAILED DESCRIPTION OF THE INVENTION

Figure 3:
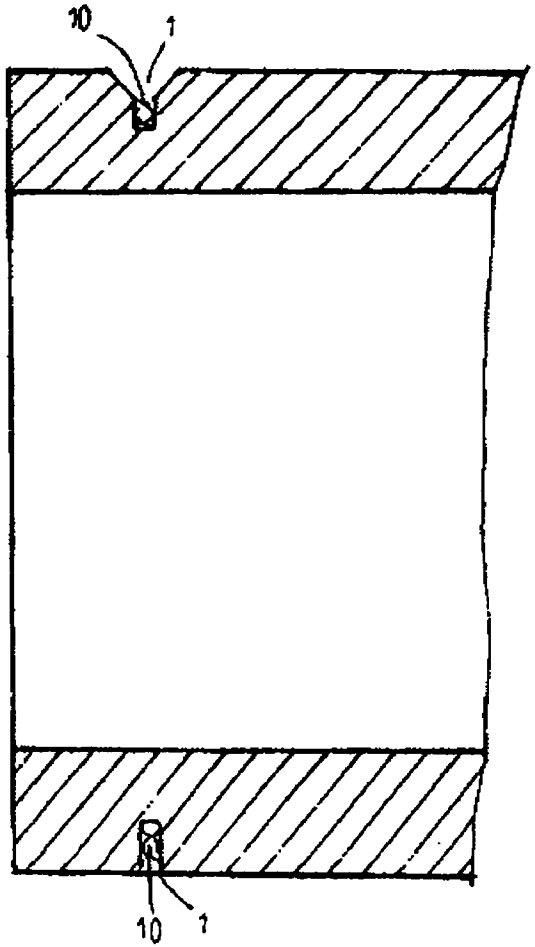
FIG. 3 is a cross-sectional drawing of the invention herein, as viewed from a vertical perspective.
Figure 2:
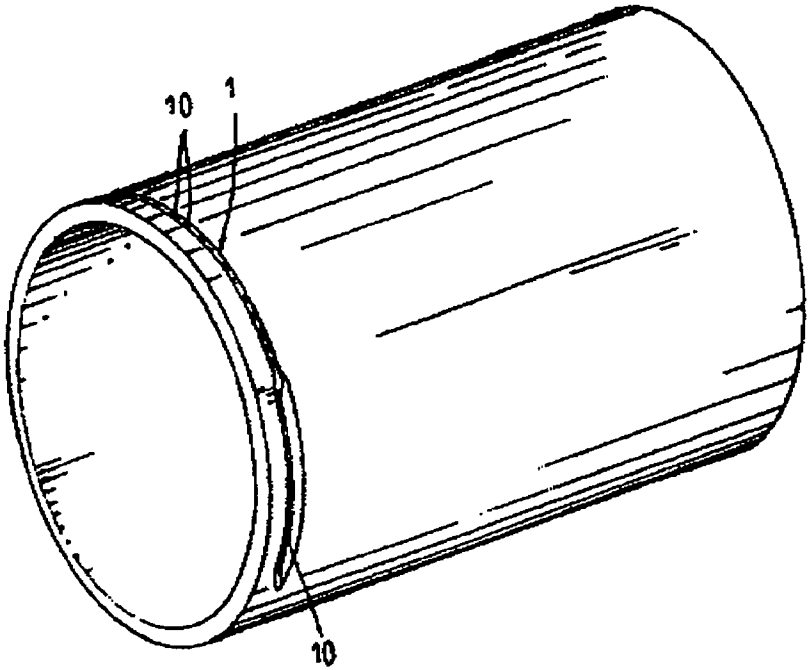
FIG. 2 (PRIOR ART)
FIG. 2 is a cross-sectional drawing of the "Yarn Cylinder with Trench" (Taiwan P/N 201810) securing yarn, as viewed from a horizontal perspective.

Referring to FIG. 3 and FIG. 4, the vertical and horizontal cross-sectional drawings of the invention herein when yarn is secured. As conveyed by the drawings, the invention herein improves the circumferential length of the trench 1 in "Yarn Cylinder with Trench" (Taiwan P/N 201810) and, furthermore, postures the teeth 10 in the trench 1 at differing angular orientations; specifically, the teeth 10 are disposed at varying inclinations along the two lateral walls of the trench 10 and, furthermore, the teeth 10 are in a crisscross formation on the said two lateral walls; as such, the longer circumferential length of the trench 10 and the contrastive skewing of the teeth 10 effectively increases yarn end snagging capacity.

As indicated in FIG. 4, when yarn is wound in the trench 1, it is caught on plurality of teeth 10 arrayed in the crisscross formation, the many differing angles of the plurality of teeth 10 in the crisscross formation situating the teeth 10 for interlocking utilization such that the yarn cylinder trench 1 not only better accommodates and binds the end of the yarn, but at the same time the interlocking characterisics secures the yarn more effectively.

In summation of the forgoing section, since the small but significant improvement of the structure of the invention herein further perfects and, furthermore, enhances the functionality of the prior art structure and thus constitutes a meaningful and original improvement and, furthermore, the present invention complies with national patent laws regarding patent applications, patent rights, the encouragement of innovation, and new patent application requirements, the invention herein is submitted for review and the granting of the commensurate patent rights.

The invention claimed is:

1. An improved structure yarn cylinder consisting of a hollow columnar member utilized for winding yarn, wherein the said columnar hollow member is of one-piece plastic construction with a trench of an appropriate depth and width formed around its circumference; the said trench structure secures the end of the yarn such that when the yarn is wound around the yarn cylinder, the yarn will prevent from loosing and slippage, wherein the improvement comprises that a circumferential angle of the said trench is at minimum 350 degrees, numerous teeth are disposed at differing angular orientation along two lateral walls of the said trench and, furthermore, the said teeth are in a crisscross formation on the said two lateral walls; as such, a longer circumferential length of the said trench and a contrastive skewing of the said teeth effectively increases yarn end snagging capacity.

* * * * *